US008265327B2

(12) United States Patent
Ishizaka

(10) Patent No.: US 8,265,327 B2
(45) Date of Patent: Sep. 11, 2012

(54) EAR PIECE AND EARPHONE

(75) Inventor: Kazunori Ishizaka, Tokyo-To (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 99 days.

(21) Appl. No.: 12/928,809

(22) Filed: Dec. 20, 2010

(65) Prior Publication Data

US 2011/0158457 A1 Jun. 30, 2011

(30) Foreign Application Priority Data

Dec. 25, 2009 (JP) ..... 2009-294483
Dec. 15, 2010 (JP) ..... 2010-279053

(51) Int. Cl.
*H04R 25/00* (2006.01)

(52) U.S. Cl. ..... 381/380; 381/324; 381/328

(58) Field of Classification Search ..... 381/309, 381/322, 324, 325, 328, 72, 74, 380, 382; 181/129, 130, 135; 128/864, 867
See application file for complete search history.

(56) References Cited

U.S. PATENT DOCUMENTS 4,447,677 A * 5/1984 Miyahra et al. ..... 381/324
5,887,070 A * 3/1999 Iseberg et al. ..... 381/380
7,082,206 B2 * 7/2006 Mahoney et al. ..... 381/328

FOREIGN PATENT DOCUMENTS

JP 2008-277909 11/2008

* cited by examiner

*Primary Examiner* — Huyen D Le
(74) *Attorney, Agent, or Firm* — Renner, Kenner, Greive, Bobak, Taylor & Weber

(57) ABSTRACT

An ear piece to be detachably attached to a sound tube protruding from a housing of an earphone has a base portion with a through hole. The through hole has an inner wall with a first, a second, and a third portion continuously provided in order when viewed from the housing. The first portion protrudes inwardly and has a first distance from a protruding inner surface of the first portion to an axis line passing through the cross section of the base portion and the through hole. The second portion has a circumferential inner surface having a second distance longer than the first distance to the axis line. The third portion is formed continuously with the second portion, having a circumferential inner surface with a third distance longer than the second distance to the axis line.

4 Claims, 9 Drawing Sheets

EAR PIECE AND EARPHONE

CROSS-REFERENCE TO RELATED APPLICATIONS

This application is based on and claims the benefit of priority from the prior Japanese Patent Application No. 2009-294483 filed on Dec. 25, 2009 and No. 2010-279053 filed on Dec. 15, 2010, the entire contents of which are incorporated herein by reference.

BACKGROUND OF THE INVENTION

The present invention relates to an ear piece and an earphone. Specifically, this invention relates to an ear piece attached to a sound tube that protrudes from an earphone body and inserted into the ear channel of a user's ear with the sound tube, and to an earphone to which the ear piece is attached.

One popular earphone is a so-called canal type in which an ear piece is detachably attached to a sound tube that protrudes from an earphone body and is inserted into the ear channel of a user's ear with the sound tube.

The canal type earphone is divided into a type in which a speaker unit is installed in an earphone body (referred to as a unit-installed type, hereinafter) and another type in which a speaker unit is mounted on the top of a sound tube (referred to as a top mount type, hereinafter).

A unit-installed type earphone is disclosed in Japanese Un-Examined Patent Publication No. 2008-277909 (referred to as a document 1, hereinafter).

The unit-installed type earphone disclosed in the document 1 is equipped with a filter member for sound characteristics adjustments that is fixed to an ear piece detachably attached to a sound tube, for achieving desired sound characteristics.

Also disclosed in the document 1 is that initial sound characteristics can be regained by replacing the ear piece with a new one if the mesh of a filter member is filled with a foreign body such as earwax.

The configurations of the earphone disclosed in the document 1 are that: a filter member is bonded to an ear piece with a double-sided tape; and an annular filter member is fit in a large-diameter section of the through hole of an ear piece.

Ear pieces are usually made of a rubber material such as silicon rubber.

The earphone disclosed in the document 1 and equipped with a rubber-made ear piece is disadvantageous in that the filter member could be fallen off or detached if a double-sided tape cannot exhibit a high adhesion force under a low-temperature environment, due to the attachment of dust to the surface of the filter member or the ear piece to be bonded, etc.

Moreover, in the assembly operation of the earphone disclosed in the document 1, the ear piece having the annular filter member fit in the large-diameter section thereof is deformed to a greater extent when it is attached to the sound tube. And, when the ear piece is deformed, the filter member could be displaced or detached from a predetermined position in the large-diameter section of the ear piece.

Accordingly, the earphone disclosed in the document 1 has room for improvement in assembly workability.

SUMMARY OF THE INVENTION

A purpose of the present invention is to provide an ear piece equipped with a filter unit attached to a speaker unit that is installed in a sound tube portion or attached to the top of the sound tube portion, for sound characteristics adjustments and protection of the speaker unit from a foreign body such as earwax, the filter unit being not detached when the ear piece is attached to the sound tube portion, thus exhibiting excellent assembly workability in assembly, and to provide an earphone equipped with such an ear piece.

The present invention provides an ear piece to be detachably attached to a sound tube portion that protrudes from a housing of an earphone, the ear piece comprising: a base portion having a through hole; and a filter unit including: a filter holder having a bottom portion with an opening and having a circumferential wall portion that rises from around the bottom portion; and a filter attached to the filter holder to cover the opening of the bottom portion, wherein the through hole of the base portion has an inner wall that is formed by a first engaging portion, a second engaging portion, and a third engaging portion that are continuously provided in order when viewed from the housing, wherein the first engaging portion protrudes inwardly and has a first distance from a protruding inner surface of the first engaging portion to an axis line that passes through a cross section of the base portion and the through hole, the first distance being the minimum distance from the protruding inner surface to the axis line when the protruding inner surface has no constant distance from the axis line; the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the filter unit is installed in the through hole of the base portion so that the circumferential wall portion of the filter holder is fit in the third engaging portion of the through hole and the bottom portion of the filter holder is located in a specific position on the axis line and within a length of the third engaging portion.

Moreover, the present invention provides an earphone comprising: a housing; a sound tube portion protruding from the housing and having at least a first circumferential groove therearound; a speaker unit provided in contact with a protruding top of the sound tube portion; a unit holder having a bottom surface with sound holes provided thereon and a first circumferential wall portion that rises from around the bottom surface, the speaker unit being held by the unit holder as being surrounded by the first circumferential wall portion, the unit holder being attached to the sound tube portion to cover the protruding top of the sound tube portion; a filter unit including a filter holder having a bottom portion with an opening and having a second circumferential wall portion that rises from around the bottom portion, and including a filter attached to the filter holder to cover the opening of the bottom portion, the filter unit being attached to the unit holder to cover the bottom surface of the unit holder; and an ear piece including a base portion with a through hole having an inner wall that is formed by a first engaging portion, a second engaging portion, and a third engaging portion that are continuously provided in order, wherein the first engaging portion protrudes inwardly and has a first distance from a protruded inner surface of the first engaging portion to an axis line that passes through a cross section of the base portion and the through hole, the first distance being the minimum distance from the protruded inner surface to the axis line when the protrude inner surface has no constant distance from the axis line; the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the first engaging portion of the ear piece is detachably engaged with the first circumferential groove of the sound tube portion, the second engaging portion of the ear piece is in contact with the first circumferential wall portion of the unit holder, and the third engaging portion of the ear piece is engaged with the second circumferential wall portion of the filter holder.

Furthermore, the present invention provides an earphone comprising: a housing; a sound tube portion having a protruding top that protrudes from the housing and having a circumferential groove formed on a first outer surface of the sound tube portion; a speaker unit installed in the housing; a filter unit including a filter holder having a bottom portion with an opening and having a circumferential wall portion that rises from around the bottom portion, and including a filter attached to the filter holder to cover the opening of the bottom portion, the filter unit being attached to the sound tube portion to cover a protruding top of the sound tube; and an ear piece including a base portion with a through hole having an inner wall that is formed by a first engaging portion, a second engaging portion, and a third engaging portion that are continuously provided in order, wherein the first engaging portion protrudes inwardly and has a first distance from a protruded inner surface of the first engaging portion to an axis line that passes through a cross section of the base portion and the through hole, the first distance being the minimum distance from the protruded inner surface to the axis line when the protrude inner surface has no constant distance from the axis line; the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the first engaging portion of the ear piece is detachably engaged with the circumferential groove of the sound tube portion, the second engaging portion of the ear piece is in contact with a second outer surface of the sound tube portion, the second outer surface being located continuously with the first outer surface of the sound tube portion towards the protruding top, and the third engaging portion of the ear piece is engaged with the circumferential wall portion of the filter holder.

DETAILED DESCRIPTION OF PREFERRED EMBODIMENT

A preferred embodiment according to the present invention will be described with reference to the attached drawings.

Figure 1:
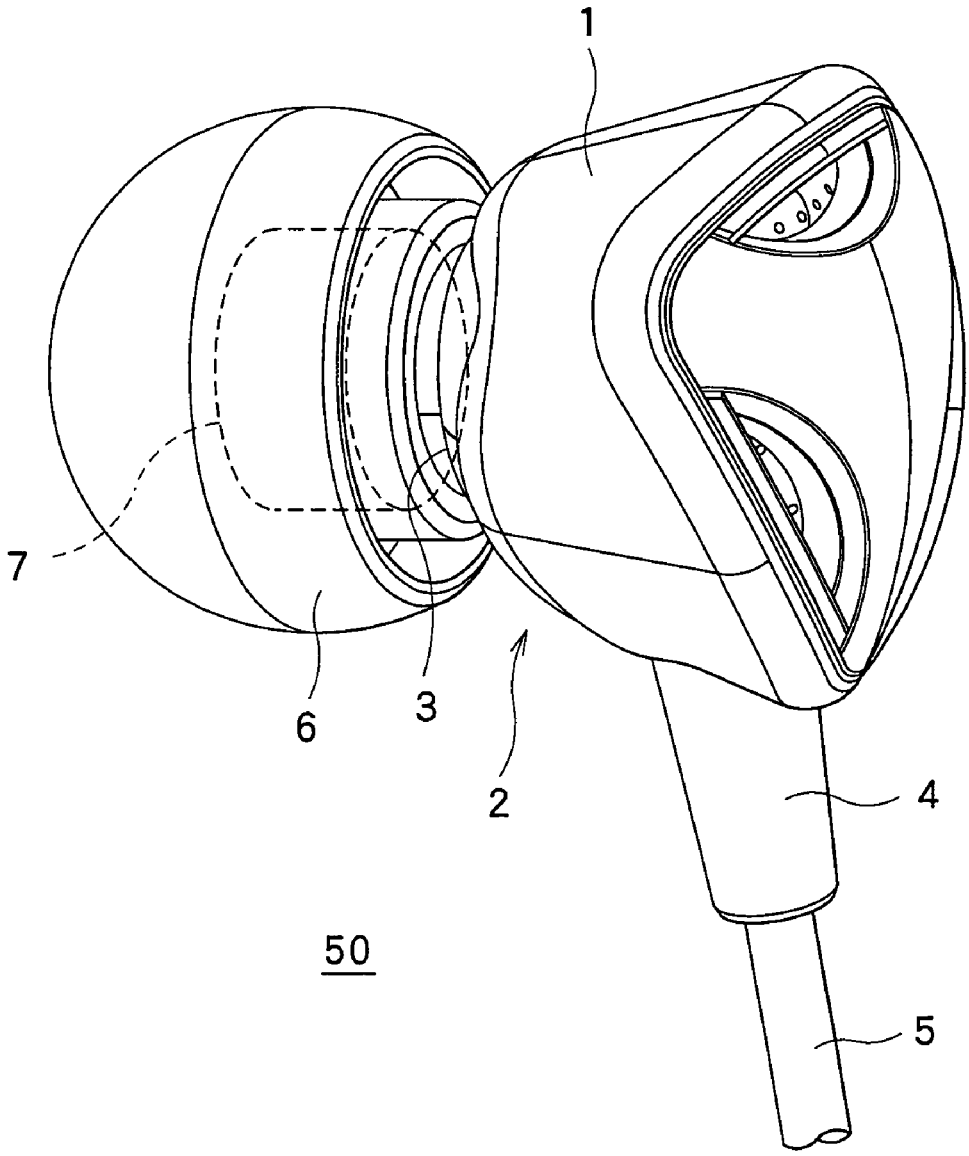
FIG. 1 shows an external perspective view of an embodiment of an earphone according to the present invention.

FIG. 1 shows is an external perspective view of an earphone 50, an embodiment of the present invention.

The earphone 50, a top mount type, is equipped with: a box-like hosing 1; a main body 2 having the hosing 1; a sound tube portion 3 protruding from the hosing 1; a bushing 4 extending outwardly from the housing 1; and a cord 5 running from the housing 1 through the bushing 4.

Detachably attached to the top of the sound tube portion 3 is an ear piece 6 made of a flexible material such as silicon rubber.

Attached to the top of the sound tube portion 3 and covered by the ear piece 6 is a speaker unit 7, indicated by a broken line, that converts audio signals externally supplied through the cord 5 into sounds and gives off the sounds.

As shown in FIG. 1, in the top mount type, the speaker unit 7 is attached to the top of the sound tube portion 3. The speaker unit 7 may, however, be installed in the housing 1.

Figure 2:
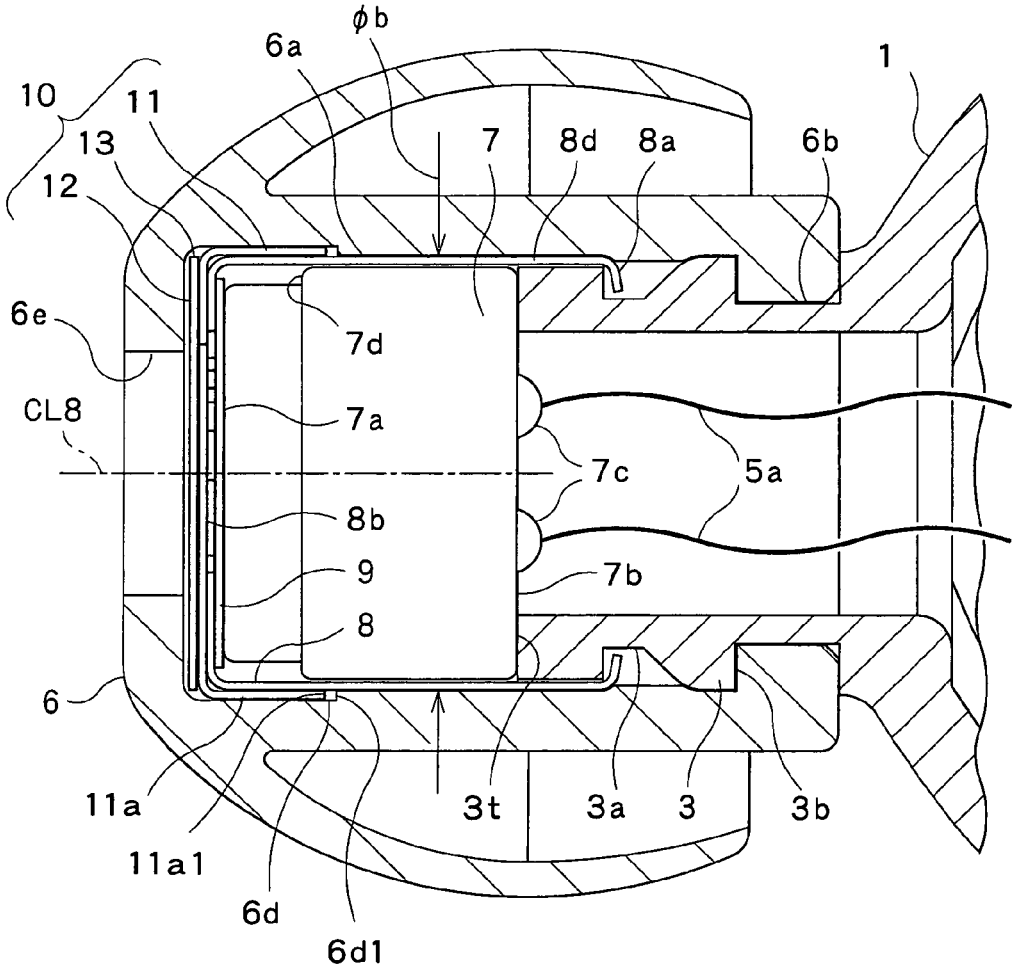
FIG. 2 shows a partially sectional view of the embodiment of the earphone according to the present invention.
Figure 3:
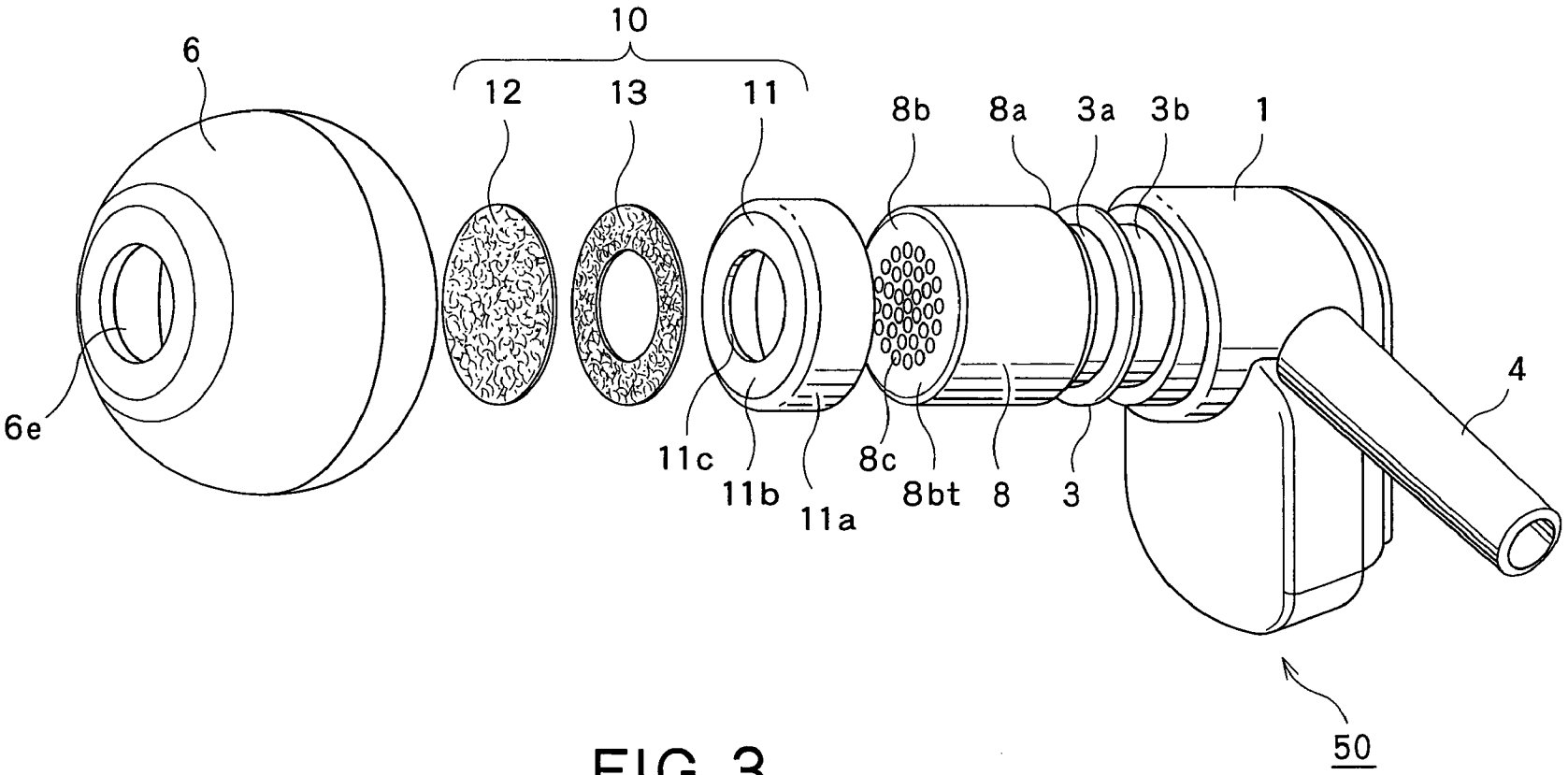
FIG. 3 shows a partially exploded view of the embodiment of the earphone according to the present invention.

Explained below in detail with respect to FIGS. 2 and 3 is the detailed structure of the earphone 50, particularly, around the sound tube portion 3 having the ear piece 6 attached thereto.

FIG. 2 shows a partially sectional view of the earphone 50 around the sound tube portion 3 having the ear piece 6 attached thereto. FIG. 3 is a partially exploded view of the earphone 50 illustrating the components installed between the ear piece 6 and the sound tube portion 3.

The housing 1 shown in FIG. 3 has a different shape from that shown in FIG. 1, because the shape of the housing 1 is not necessarily be limited to that shown in FIG. 1 in this embodiment.

As shown in FIGS. 2 and 3, the sound tube portion 3 is formed into a cylindrical shape with two circumferential grooves therearound.

The circumferential grooves are: a swaging groove 3*a* swaged in which is an end portion 8*a* of a circumferential wall portion 8*d* of a unit holder 8 (which will described later in detail); and an engaging groove 3*b* for engaging with the ear piece 6.

As shown in FIG. 2, the speaker unit 7 is attached to the sound tube portion 3 so that a bottom surface 7*b* of the speaker unit 7 is in contact with a top surface 3*t* of the sound tube portion 3.

The speaker unit 7 has a cylindrical external shape with a sound-emitting surface 7*a* and a bottom surface 7*b* at the left and right sides, respectively, in FIG. 2.

The speaker unit 7 is provided with a stepped portion 7*d* having a smaller diameter at the sound-emitting surface 7*a* side than the bottom surface 7*b* side.

Formed on the bottom surface 7*b* of the speaker unit 7 are a pair of terminals 7*c* electrically connected to which are a pair of lead wires 5*a* embedded in the cord 5.

The unit holder 8 is formed into a saucepan-like shape by sheet metal stamping, having a bottom surface 8*b* and the circumferential wall portion 8*d* that rises from around the bottom surface 8*b* in parallel with an axis line CL8.

Provided on the bottom surface 8*b* of the unit holder 8 are sound holes 8*c*, as shown in FIG. 3, through which the sounds output by the speaker unit 7 are given off.

With the unit holder 8 described above, the speaker unit 7 is attached to the top of the sound tube portion 3, as explained below.

The lead wires 5*a* connected to the terminals 7*c* of the speaker unit 7 beforehand are inserted into the sound tube portion 3 from the top side. Then, the speaker unit 7 is installed in the unit holder 8, with the sound-emitting surface 7*a* being located at the bottom surface 8*b* side of the unit holder 8.

The unit holder 8 having the speaker unit 7 installed therein is put on the top of the sound tube portion 3 to cover the top. The end portion 8*a* of the circumferential wall portion 8*d* of the unit holder 8 is then swaged into the swaging groove 3*a* of the sound tube portion 3 so that the speaker unit 7 is fixed between the top surface 3*t* of the sound tube portion 3 and the bottom surface 8*b* of the unit holder 8.

Inserted between the sound-emitting surface 7*a* of the speaker unit 7 and the bottom surface 8*b* of the unit holder 8, as an option, is an adjustment filter 9 for basic sound-quality adjustments of the speaker unit 7, as shown in FIG. 2.

Described next in detail with reference to FIGS. 2 to 6 is a filter unit 10 for sound characteristics adjustments of the earphone 50 and protection of the sound tube portion 3 from the entering of a foreign body such as earwax.

As shown in FIG. 3, the filter unit 10 is constituted by a filter holder 11, a filter 12, and a fixing member 13 that fixes the filter 12 to the filter holder 11.

Figure 5:
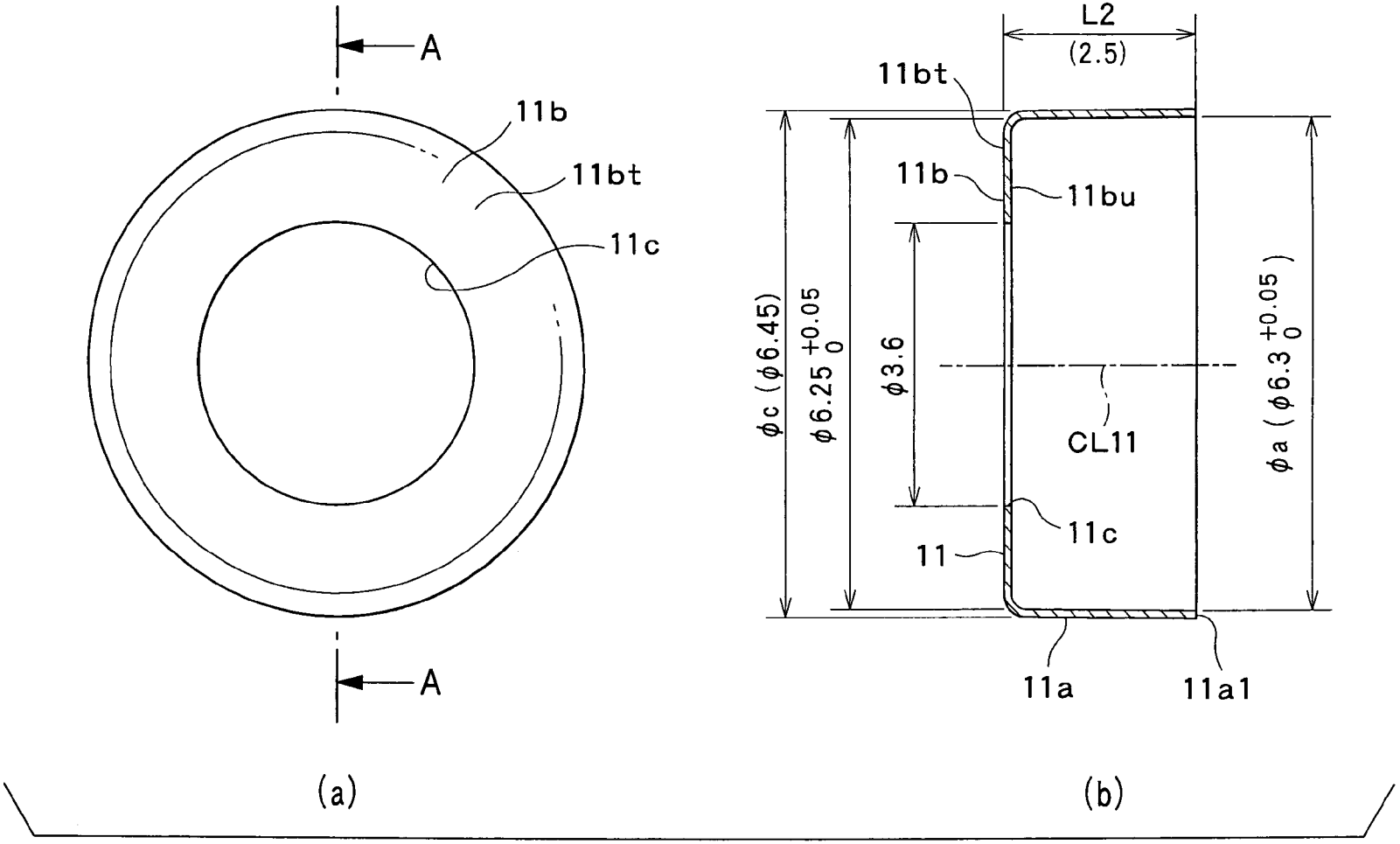
FIG. 5 shows a filter holder to be used in the embodiment of the earphone according to the present invention, with a plan view (a) and a sectional view (b) taken on line A-A of the plan view (a)

FIG. 5 shows the filter holder 11 in a plan view (a) and a sectional view (b) taken on line A-A of the plan view (a). The dimensions of the filter holder 11 indicated in the sectional view (b) are just an example.

As shown in FIG. 5, the filter holder 11 is formed having an annular bottom portion 11*b* and a circumferential wall portion 11*a* that rises from around the bottom portion 11*b*.

Provided on the annular bottom portion 11*b* is a circular opening 11*c* through which the sounds output by the speaker unit 7 are given off. The bottom portion 11*b* and the opening 11*c* are not necessary limited to a circular shape.

Figure 6:
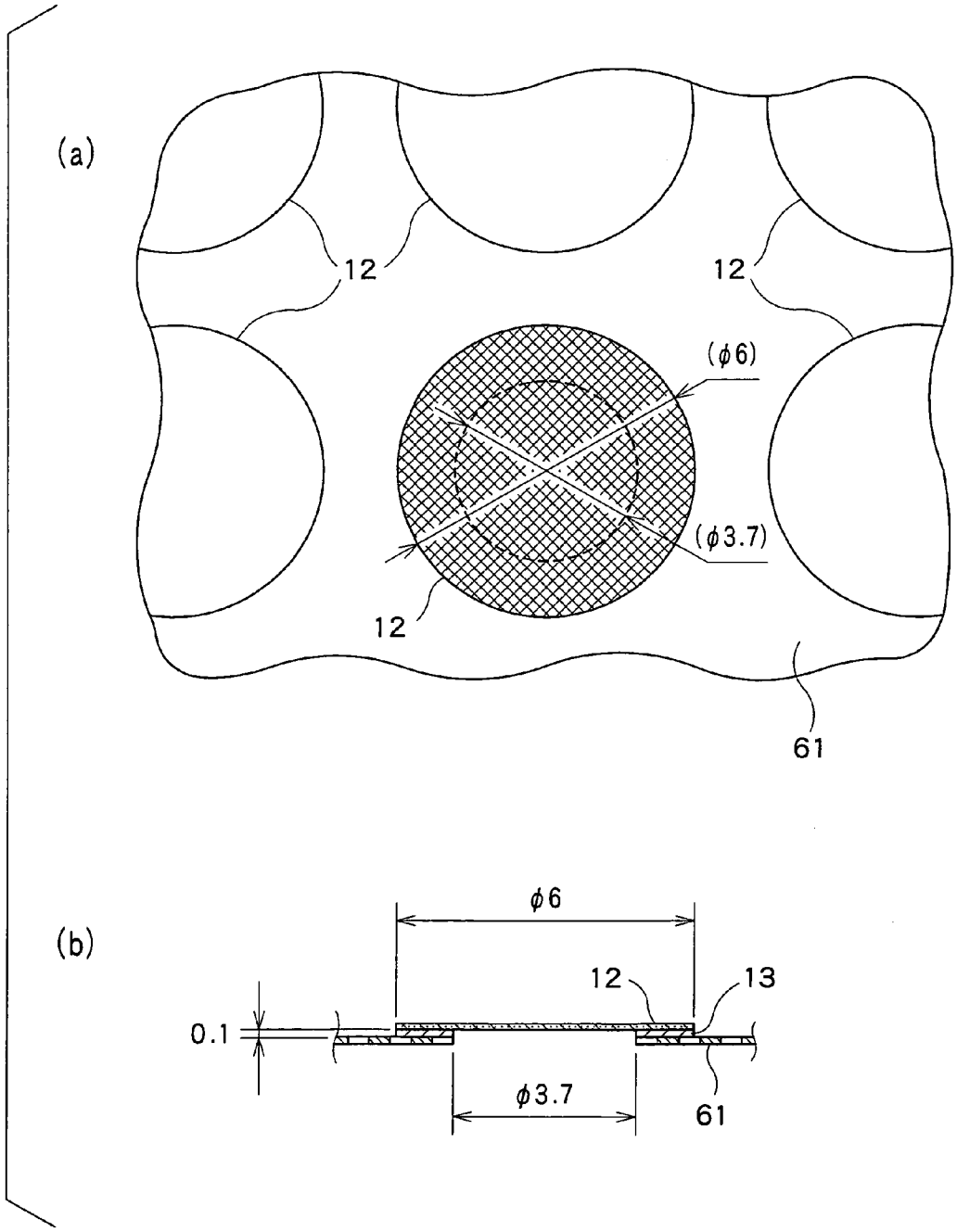
FIG. 6 shows a filter to be used in the embodiment of the earphone according to the present invention, with a plan view (a) and a partially sectional view (b) illustrating the filter to be shipped.

FIG. 6 shows the filter 12 in a plan view (a) and a partially sectional view (b) illustrating the filter 12 to be shipped. The dimensions of the filter 12 indicated in the plan and sectional views (a) and (b) are just an example.

The filter 12 is a mesh member made of PET (Polyethylene Terephthalate). A PET-made mesh member at 230 in opening may, for example, be used as the filter 12.

As shown in FIG. 6, a specific number of filters 12 are arranged on a separator 61 at regular intervals with an annular double-sided tape as the fixing member 13 (FIG. 3).

Each filter 12 is peeled off from the separator 61, with the double-sided tape 13 bonded thereto, and bonded to an outer surface 11*bt* (FIG. 5) of the bottom portion 11*b* of the filter holder 11 to cover the opening 11*c*, thus forming the filter unit 10.

The filter holder 11 has an internal diameter Øa (FIG. 5) a little bit larger than an outer diameter Øb (FIG. 2) of the unit holder 8 so that the filter unit 10 can be attached to the unit holder 8, with the filter holder 11 being set on the top of the unit holder 8 to tightly cover the top with almost no gap.

In this process, the filter unit 10 is pushed towards the unit holder 8 so that an inner surface 11*bu* (FIG. 5) of the bottom portion 11*b* of the filter holder 11 is in contact with an outer surface 8*bt* (FIG. 3) of the bottom portion 8*b* of the unit holder 8.

Figure 4:
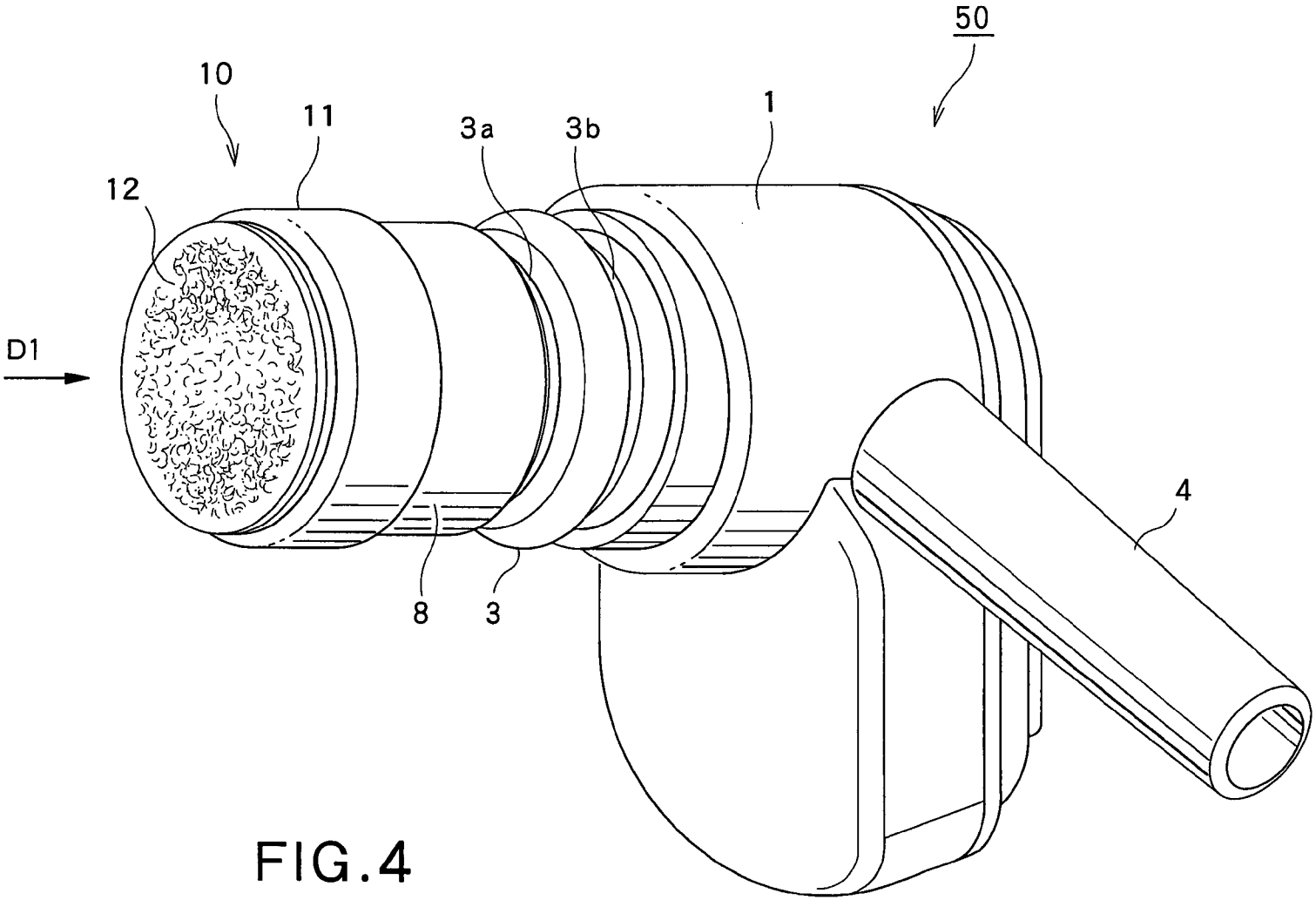
FIG. 4 shows an external perspective view of the embodiment of the earphone according to the present invention, illustrating one operation in assembly.

FIG. 4 illustrates that the filter unit 10 is attached to the top of the unit holder 8 to cover the top.

Figure 7:
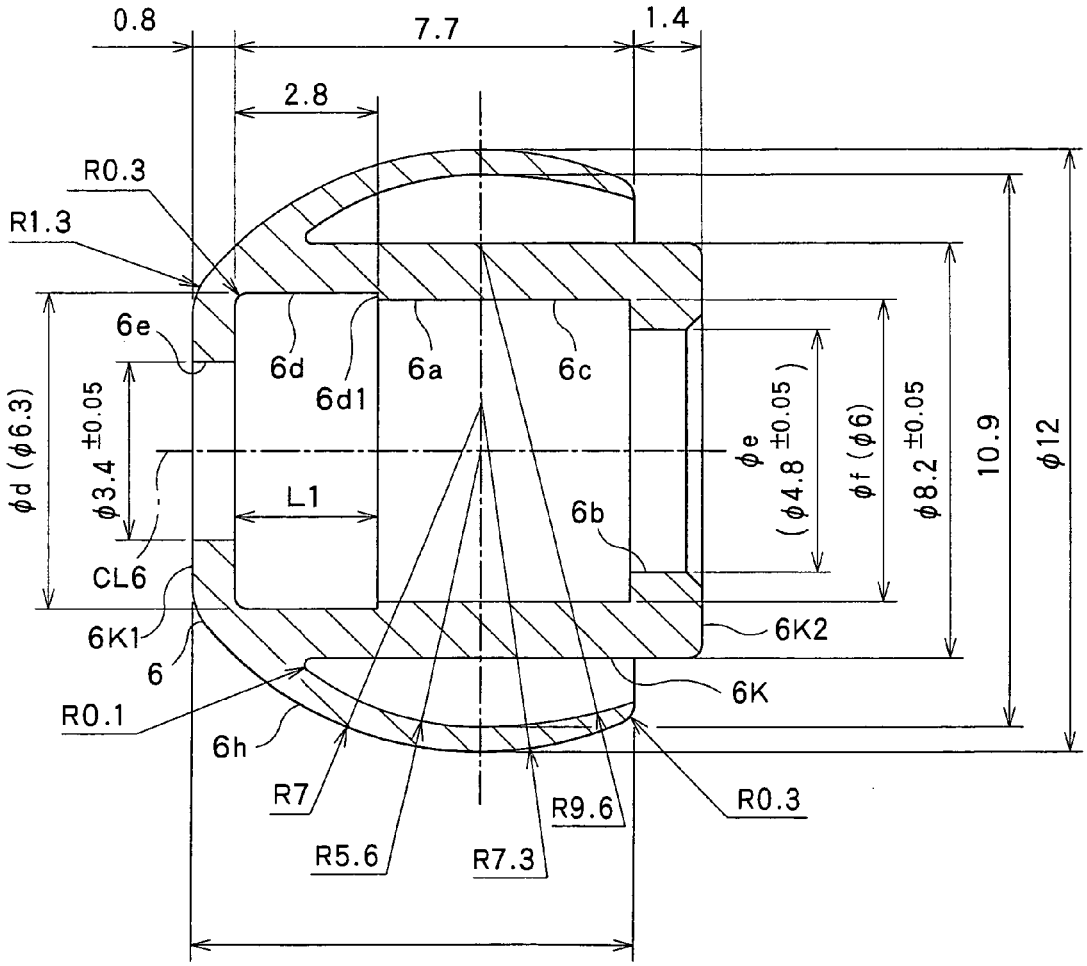
FIG. 7 shows a sectional view of an ear piece to be used in the embodiment of the earphone according to the present invention.

Shown in FIG. 7 is a sectional view of the ear piece 6 in this embodiment, with exemplary dimensions.

The ear piece 6 is made of a flexible material, such as a rubber material. Silicon rubber is one of the most preferable materials.

The ear piece 6 is provided with an annular base portion 6*k* having a through hole 6*a* and a fin portion 6*h* that is connected to one end 6*k*1 of the base portion 6*k* and extends from the end 6*k*1 towards another end 6*k*2 of the base portion 6*k*, like an umbrella.

Through the through hole 6*a*, sounds output by the speaker unit 7 are given off the outside at the end 6*k*1 of the base portion 6*k* of the ear piece 6 attached to the sound tube portion 3.

The through hole 6*a* of the ear piece 6 is formed having several portions with different diameters between the ends 6*k*1 and 6*k*2 of the base portion 6*k*: an engaging protrusion portion 6*b*, having an internal diameter Øe, that is a circumferential rib-like portion protruding inwardly to be engaged with the engaging groove 3*b* of the sound tube portion 3; a UH engaging portion 6*c* having an internal diameter Øf that is larger than the internal diameter Øe but a little bit smaller than the outer diameter Øb (FIG. 2) of the unit holder 8; a FH engaging portion 6*d* having an internal diameter Ød that is larger than the internal diameter Øf the UH engaging portion 6*c* but smaller than an outer diameter Øc (FIG. 5) of the filter holder 11; and an opening 6*e* that is provided at the end 6*k*1 of the base portion 6*k* and is formed a little bit smaller than the opening 11*c* (FIG. 5) of the filter holder 11.

The UH engaging portion 6*c* and the FH engaging portion 6*d* are continuously provided with no other components therebetween to form the through hole 6*a*.

Described next in detail is the installation of the filter unit 10 in the assembly of the earphone 50.

The filter unit 10 is attached to the unit holder 8 in a direction D1, as shown in FIG. 4, to cover the top of the unit holder 8 that covers the top of the sound tube portion 3. Then, the ear piece 6 is attached to the filter unit 10 to cover the top of the sound tube portion 3 while the ear piece 6 is being deformed at the end 6*k*2 side (FIG. 7).

The ear piece 6 is then pushed until the engaging protrusion portion 6*b* (FIG. 7) of the ear piece 6 is engaged with the engaging groove 3*b* (FIG. 2) of the sound tube portion 3, thus the ear piece 6 being attached to the sound tube portion 3.

As shown in FIG. 7, the FH engaging portion 6*d* of the ear piece 6 has a length L1 along an axis line CL6 that is longer than a length L2 (FIG. 5) of the filter holder 11 along an axis line CL11.

Thus, when the ear piece 6 is attached to the sound tube portion 3 with the engagement of the engaging protrusion portion 6*b* (FIG. 7) and the engaging groove 3*b* (FIG. 2), the circumferential wall portion 11*a* (FIG. 5) of the filter holder 11 is fit in the FH engaging portion 6*d* (FIG. 7) of the ear piece 6.

When the filter unit 10 is installed in the ear piece 6 as described above, the inner surface 11*bu* (FIG. 5) of the bottom portion 11*b* of the filter holder 11 is in contact with the outer surface 8*bt* (FIG. 3) of the bottom portion 8*b* of the unit holder 8, in this embodiment. However, the filter unit 10 may be installed in the ear piece 6 so that the inner surface 11*bu* is not in contact with the outer surface 8*bt*.

When the ear piece 6 is attached as described above, the filter unit 10 receives a compressive force inwardly from the ear piece 6. Moreover, the unit holder 8 receives a compressive force inwardly from the UH engaging portion 6*c* (FIG. 7) of the ear piece 6, that is formed having the internal diameter Øf a little bit smaller than the outer diameter Øb (FIG. 2) of the unit holder 8.

As already described, the opening 6*e* (FIG. 7) of the ear piece 6 is formed a little bit smaller than the opening 11*c* (FIG. 5) of the filter holder 11. In other words, the internal diameter of the opening 6*e* of the ear piece 6 is formed smaller than the outer diameter of the filter unit 10, as shown in FIG. 12. Thus, the filter unit 10 is not detached from the ear piece 6 in normal use.

When the filter holder 11 is installed as described above, it is located between the outer surface 8*bt* (FIG. 3) of the bottom portion 8*b* of the unit holder 8 and the end 6*k*1 (FIG. 7) of the base portion 6*k* of the ear piece 6, with the bottom surface 11*b* (FIG. 5) being held by the base portion 6*k* of the ear piece 6 at the FH engaging portion 6*d* side, the opposite of the UH engaging portion 6*c* of the ear piece 6 with respect to the stepped portion 6*d*1.

The filter 12 bonded to the outer surface 11*bt* (FIG. 5) of the bottom portion 11*b* of the filter holder 11 adjusts the sound characteristics of sounds output by the earphone 50 and also prevents a foreign body, such as earwax, from entering the unit holder 8.

Figure 8:
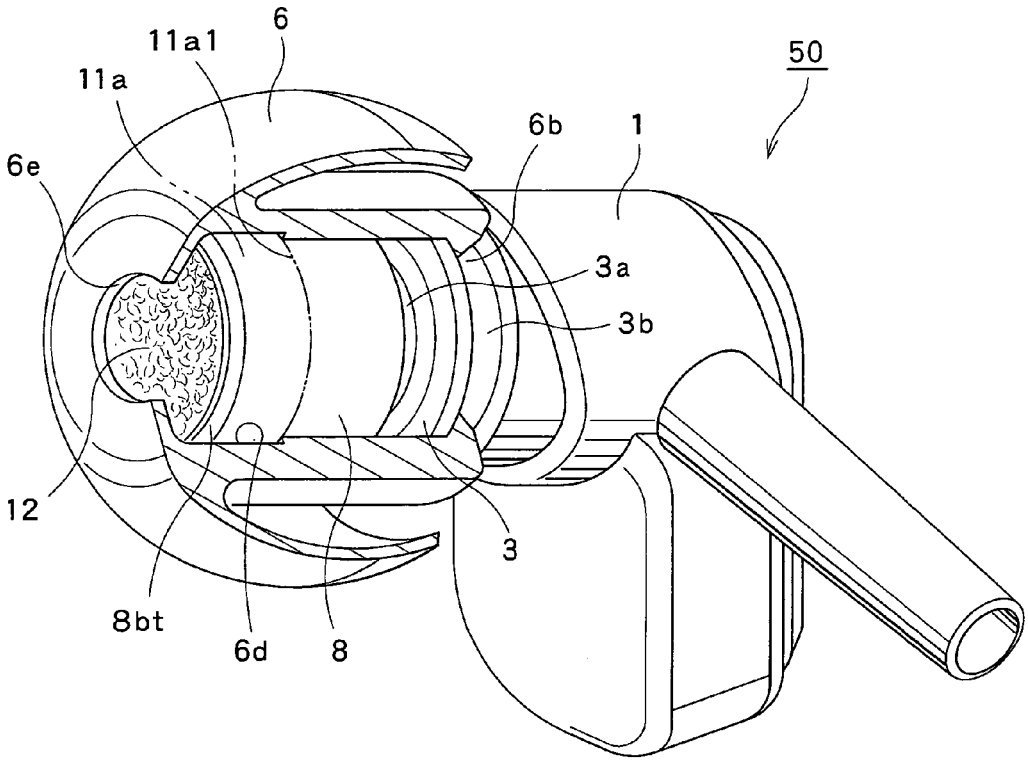
FIG. 8 shows a partially sectional view of the embodiment of the earphone according to the present invention, with the ear piece attached thereto.

FIG. 8 shows a partially sectional view of the earphone 50 with the filter holder 11 attached to the unit holder 8 to cover the top of the unit holder 8 and the ear piece 6 covering the filter holder 11 and the unit holder 8.

The circumferential wall portion 11*a* of the filter holder 11 and an end surface 11*a*1 (FIG. 5) of the wall portion 11*a* are indicated by a long dashed double-dotted line in FIG. 8. As shown in FIG. 8, the circumferential wall portion 11*a* is engaged with the FH engaging portion 6*d*.

The filter 12 can be replaced with a new one in accordance with the procedure described below when it is filled with a foreign body such as dust and earwax.

The ear piece 6 is detached from the sound tube portion 3 by peeling off the engaging protrusion portion 6*b* of the through hole 6*a* of the ear piece 6 shown in FIG. 7.

In this detaching operation, the ear piece 6 is detached from the sound tube portion 3, together with the filter unit 10. This is because when assembled: the circumferential wall portion 11*a* (FIG. 5) of the filter holder 11 of the filter unit 10 is inserted into the FH engaging portion 6*d* (FIG. 7) of the ear piece 6; and the end surface 11*a*1 (FIG. 5) of the wall portion 11*a* of the filter holder 11 is in contact with the stepped portion 6*d*1 (FIG. 7) of the FH engaging portion 6*d* at the end 6*k*2 side.

Then, a new ear piece 6 having a filter unit 10 with a filter 12 not filled with a foreign body such as earwax, assembled as described above, is attached to the unit holder 8 and then the sound tube portion 3.

Or, the through hole 6*a* of the ear piece 6 is deformed to detach the filter 12 filled with a foreign body, such as earwax, from the ear piece 6. And, a new filter unit 10 having a filter 12 not filled with a foreign body is inserted into the FH engaging portion 6*d* (FIG. 7) of the ear piece 6.

The ear piece 6, having the filter unit 10 already attached to the FH engaging portion 6*d* (FIG. 7) of the ear piece 6, is then attached to the unit holder 8 and the sound tube portion 3. The unit holder 8 is thus covered by the filter holder 11 of the filter unit 10 at the same location as before the replacement of the filter 12 in which the unit holder 8 was covered by the filter holder 11 and then the ear piece 6 was attached to the unit holder 8 and the sound tube portion 3. Thus, the earphone 50 can be used with the ear piece 6 itself reusable with no replacement.

Moreover, the filter 12 may be reused by washing the PET mesh filled with a foreign body such as earwax.

Described above is an embodiment of earphone that is a top mount type having the speaker unit 7 attached to the top of the sound tube portion 3.

Not only that, the present invention can be applied to a unit-installed type having the speaker unit 7 installed in the housing 1. Specifically, also in the unit-installed type, the filter unit 10 can be installed in the same manner as the top mount type described above. In the unit-installed type, the outer diameter of the top of the sound tube portion 3 is preferably made a little bit smaller than the internal diameter Øa (FIG. 5) of the circumferential wall portion 11*a* of the filter holder 11 so that the sound tube portion 3 can be covered by the filter unit 10 tightly with almost no gap.

Such a unit-installed type earphone according to the present invention will be described later, as a modification.

In the embodiment described above, when the ear piece 6 is attached to the sound tube portion 3, as shown in FIG. 2, the outer surface of the circumferential wall portion 11*a* (FIG. 5) of the filter holder 11 is in circumferential contact with the inner surface of the FH engaging portion 6*d* (FIG. 7) of the ear piece 6*d*.

With the circumferential contact, the circumferential wall portion 11*a* of the filter holder 11 is tightly inserted into the FH engaging portion 6*d* of the ear piece 6 so that the FH engaging portion 6*d* inwardly applies a compressive force to the circumferential wall portion 11*a*.

The compressive force generates a high friction force between the ear piece 6 and the filter holder 11. The high friction force makes it very rare that the filter unit 10 is displaced or detached from the FH engaging portion 6*d* of the ear piece 6 when the through hole 6*a* (FIG. 7) of the ear piece 6 is deformed to detach the ear piece 6 from the sound tube portion 3.

When the earphone 50 of the embodiment is assembled, the filter unit 10 can be installed in the ear piece 6 at a predetermined location, not by deforming and inserting the filter unit 10 into the ear piece 6, but by placing the filter unit 10 to the sound tube portion 3 (with the unit holder 8 interposed therebetween) and attaching the ear piece 6 to the sound tube portion 3 to cover the top of the sound tube portion 3, as described above.

This assembly procedure is thus excellent in workability, without the filter unit 10 being detached when the ear piece 6 is attached to the sound tube portion 3.

It is further understood by those skilled in the art that the foregoing description is a preferred embodiment of the disclosed device and that various changes and modifications may be made in the invention without departing from the spirit and scope thereof.

Figure 9:
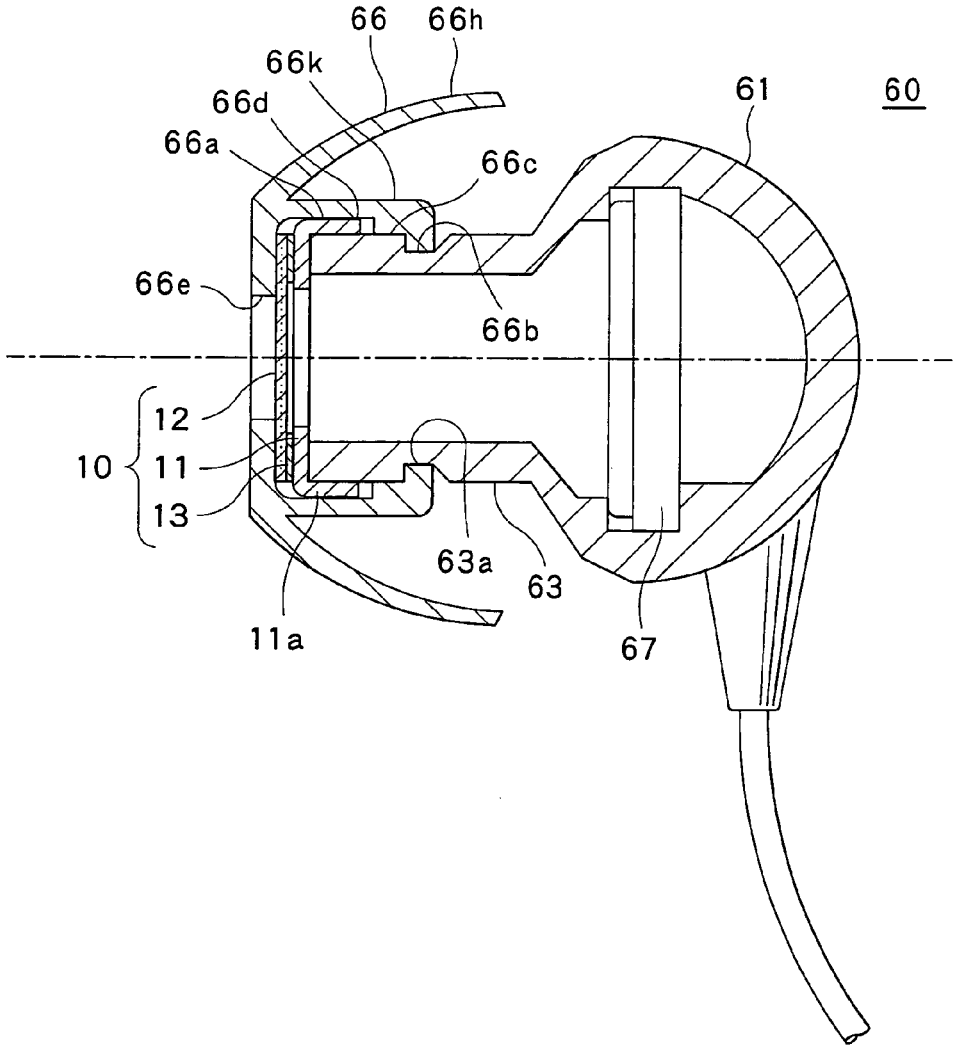
FIG. 9 shows a sectional view of a modification to the embodiment of the earphone according to the present invention.

For example, shown in FIG. 9 is a modification of the present invention, that is a unit-installed type earphone having a speaker unit installed in a housing.

As shown in FIG. 9, a unit-installed type earphone 60 is equipped with: a housing 61; a speaker unit 67 installed in the housing 61; a sound tube portion 63 formed protruding from the housing 61, with a circumferential groove 63*a* formed therearound; and an ear piece 66 made of silicon rubber and having an annular base portion 66*k* with a through hole 66*a*, an opening 66*e* and an engaging protrusion portion 66*b*, and a fin portion 66*h*.

When the earphone 60 is assembled, the base portion 66*k* of the ear piece 66 is attached to the sound tube portion 63 so that the sound tube portion 63 is inserted into the through hole 66*a* of the base portion 66*k*.

Then, the engaging protrusion portion 66*b* of the ear piece 66 is engaged with the circumferential groove 63*a* of the sound tube portion 63, thus the ear piece 66 being attached to the sound tube portion 63.

The filter unit 10, identical to the counterpart 10 shown in FIG. 5 of the embodiment, having the filter holder 11, the filter 12, and the fixing member 13, is attached to the top of the sound tube portion 63, with the internal surface of the filter holder 11 covering the outer surface of the top of the sound tube portion 63 tightly with almost no gap.

The through hole 66*a* of the ear piece 66 is formed having, from the engaging protrusion portion 66*b* side: an engaging portion 66*c* having an internal diameter that is the same as or a little bit smaller than the outer diameter of the sound tube portion 63; and a FH engaging portion 66*d* having an internal diameter that is larger than the internal diameter of the engaging portion 66*c* but a little bit smaller than the outer diameter of the filter holder 11.

When the ear piece 66 is attached to the sound tube portion 63, the circumferential wall portion 11*a* (FIG. 5) of the filter holder 11 is tightly fit in the FH engaging portion 66*d* of the ear piece 66.

The opening 66*e* provided at the top of the ear piece 66 is formed having an internal diameter smaller than the outer diameter of the filter unit 10 so that the filter unit 10 that has the filter holder 11 with the circumferential wall portion 11*a* being fit in the FH engaging portion 66*d* of the ear piece 66, as described above, is not displaced or detached from the ear piece 66.

When the earphone 60 of the modification is assembled into a usable condition, the outer surface of the circumferential wall portion 11*a* (FIG. 5) of the filter holder 11 is in circumferential contact with the inner surface of the FH engaging portion 66*d* of the ear piece 66.

With the circumferential contact, the circumferential wall portion 11*a* of the filter holder 11 is tightly fit in the FH engaging portion 66*d* of the ear piece 66 so that the FH engaging portion 66*d* inwardly applies a compressive force to the circumferential wall portion 11*a*.

The compressive force generates a high friction force between the ear piece 66 and the filter holder 11. The high friction force makes it very rare that the filter unit 10 is displaced or detached from the FH engaging portion 66*d* of the ear piece 66 when the through hole 66*a* (FIG. 9) of the ear piece 66 is deformed to detach the ear piece 66 from the sound tube portion 63.

When the earphone 60 of the modification is assembled, the filter unit 10 can be installed in the ear piece 66 at a predetermined location, not by deforming and inserting the filter unit 10 into the ear piece 66, but by placing the filter unit 10 to the sound tube portion 33 and attaching the ear piece 66 to the sound tube portion 63 to cover the top of the sound tube portion 63, as described above.

This assembly procedure is thus excellent in workability, without the filter unit 10 being detached when the ear piece 66 is attached to the sound tube portion 63.

In addition to the modification described above, various changes and modifications may further be made in the invention without departing from the spirit and scope thereof, which is understood by those skilled in the art.

For example, the filter 12 is not necessarily a mesh member of PET. The filter 12 may be a mesh member of metal, punched metal, unwoven fabric, a sponge-like material, etc., as long as it can prevent a foreign body of a specific size or larger from passing therethrough. The specific size of the foreign body is, for example, 0.2 mm.

The ear piece 6 (66) is not necessarily made of silicon rubber and provided with the annular base portion 6*k* (66*k*) and the fin portion 6*h* (66*h*), as shown in FIG. 7 (FIG. 9). It may be of urethane form with a circular truncated cone-like outer shape.

The fixing member 13 to be used for fixing the filter 12 to the filter holder 11 is not necessarily a double-sided tape but an adhesive, for example.

The sound tube portion 3 is not necessarily formed into a cylinder with a circular cross section. It may be a tube with an oval or a polygonal cross section. The base portion 6*k* (FIG. 7) of the ear piece 6 to be attached to the sound tube portion 3 is also not necessarily formed into a cylinder, or a tube with a circular cross section. It may be tube with an oval section or a polygonal section. The same is true for the modification shown in FIG. 9.

The filter holder 11 (FIG. 5) may be formed in any shape irrespective of the cross-sectional shape of the sound tube portion 3, as long as the filter holder 11 can be attached to the top of the sound tube portion 3 to tightly cover the top with almost no gap. The same is true for the modification shown in FIG. 9.

Moreover, the filter holder 11 and the FH engaging portion 6*d* (FIG. 7) of the ear piece 6 do not necessarily have the circular cross-sectional shape, as long as the filter holder 11 is tightly inserted into the FH engaging portion 6*d* with almost no gap. The same is true for the modification shown in FIG. 9.

Thus, in order for the filter holder 11 to be tightly inserted into the ear piece 6, the ear piece 6 is formed having a through hole 6*a* with a first engaging portion (6*b*), a second engaging portion (6*c*), and a third engaging portion (6*d*) that are continuously provided in order, forming an inner wall of the through hole, with respect an axis line CL6 (FIG. 7) that passes through the cross section (that is not necessarily circular) of the base portion 6*k* and the through hole 6*a* of the ear piece 6.

The first engaging portion (6*b*) is a circumferential rib-like portion protruding inwardly and has a first distance from a protruding inner surface of the first engaging portion to the axis line CL6, the first distance being the minimum distance from the protruding inner surface to the axis line CL6 when the protruding inner surface has no constant distance from the axis line CL6.

The second engaging portion (6*c*) has a circumferential inner surface having a second distance to the axis line CL6, the second distance being longer than the first distance and being the minimum distance from the circumferential inner surface to the axis line CL6 when the circumferential inner surface has no constant distance from the axis line CL6.

The third engaging portion (6*d*) is formed continuously with the second engaging portion (6*c*) and has a circumferential inner surface having a third distance to the axis line CL6, the third distance being longer than the second distance and being the minimum distance from the circumferential inner surface of the third engaging portion (6*d*) to the axis line CL6 when the circumferential inner surface of the third engaging portion (6*d*) has no constant distance from the axis line CL6.

The first, second and third engaging portions defined as above are applied to the earpiece 6 shown in FIG. 7 and also the ear piece 66 shown in FIG. 9.

As disclosed above in detail, the present invention achieves excellent assembly workability for an earphone equipped with an ear piece having a filter unit attached to a speaker unit installed in a sound tube portion or attached to the top of the sound tube portion, the filter unit being not detached when the ear piece is attached to the sound tube portion.

What is claimed is:

1. An ear piece to be detachably attached to a sound tube portion that protrudes from a housing of an earphone, the ear piece comprising:

a base portion having a through hole; and a filter unit including:

a filter holder having a bottom portion with an opening and having a circumferential wall portion that rises from around the bottom portion; and a filter attached to the filter holder to cover the opening of the bottom portion, wherein the through hole of the base portion has an inner wall that is formed by a first engaging portion, a second engaging portion, and a third engaging portion that are continuously provided in order when viewed from the housing, wherein the first engaging portion protrudes inwardly and has a first distance from a protruding inner surface of the first engaging portion to an axis line that passes through a cross section of the base portion and the through hole, the first distance being the minimum distance from the protruding inner surface to the axis line when the protruding inner surface has no constant distance from the axis line;

the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the filter unit is installed in the through hole of the base portion so that the circumferential wall portion of the filter holder is fit in the third engaging portion of the through hole and the bottom portion of the filter holder is located in a specific position on the axis line and within a length of the third engaging portion.

2. An earphone comprising:

a housing;

a sound tube portion protruding from the housing and having at least a first circumferential groove therearound;

a speaker unit provided in contact with a protruding top of the sound tube portion;

a unit holder having a bottom surface with sound holes provided thereon and a first circumferential wall portion that rises from around the bottom surface, the speaker unit being held by the unit holder as being surrounded by the first circumferential wall portion, the unit holder being attached to the sound tube portion to cover the protruding top of the sound tube portion;

a filter unit including a filter holder having a bottom portion with an opening and having a second circumferential wall portion that rises from around the bottom portion, and including a filter attached to the filter holder to cover the opening of the bottom portion, the filter unit being attached to the unit holder to cover the bottom surface of the unit holder; and an ear piece including a base portion with a through hole having an inner wall that is formed by a first engaging portion, a second engaging portion, and a third engaging portion that are continuously provided in order, wherein the first engaging portion protrudes inwardly and has a first distance from a protruded inner surface of the first engaging portion to an axis line that passes through a cross section of the base portion and the through hole, the first distance being the minimum distance from the protruded inner surface to the axis line when the protrude inner surface has no constant distance from the axis line;

the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the first engaging portion of the ear piece is detachably engaged with the first circumferential groove of the sound tube portion, the second engaging portion of the ear piece is in contact with the first circumferential wall portion of the unit holder, and the third engaging portion of the ear piece is engaged with the second circumferential wall portion of the filter holder.

3. The earphone according to claim 2, wherein the sound tube portion has a second protruding groove therearound, the second protruding groove being formed between the protruding top and the first circumferential groove, the first circumferential wall portion of the unit holder being engaged with the second protruding groove of the sound tube portion, thus the unit holder covering the protruding top of the sound tube portion.

4. An earphone comprising:

a housing;

a sound tube portion having a protruding top that protrudes from the housing and having a circumferential groove formed on a first outer surface of the sound tube portion;

a speaker unit installed in the housing;

a filter unit including a filter holder having a bottom portion with an opening and having a circumferential wall portion that rises from around the bottom portion, and including a filter attached to the filter holder to cover the opening of the bottom portion, the filter unit being attached to the sound tube portion to cover a protruding top of the sound tube; and an ear piece including a base portion with a through hole having an inner wall that is formed by a first engaging portion, a second engaging portion, and a third engaging portion that are continuously provided in order, wherein the first engaging portion protrudes inwardly and has a first distance from a protruded inner surface of the first engaging portion to an axis line that passes through a cross section of the base portion and the through hole, the first distance being the minimum distance from the protruded inner surface to the axis line when the protrude inner surface has no constant distance from the axis line;

the second engaging portion has a circumferential inner surface having a second distance to the axis line, the second distance being longer than the first distance and being the minimum distance from the circumferential inner surface to the axis line when the circumferential inner surface has no constant distance from the axis line; and the third engaging portion is formed continuously with the second engaging portion and has a circumferential inner surface having a third distance to the axis line, the third distance being longer than the second distance and being the minimum distance from the circumferential inner surface of the third engaging portion to the axis line when the circumferential inner surface of the third engaging portion has no constant distance from the axis line, wherein the first engaging portion of the ear piece is detachably engaged with the circumferential groove of the sound tube portion, the second engaging portion of the ear piece is in contact with a second outer surface of the sound tube portion, the second outer surface being located continuously with the first outer surface of the sound tube portion towards the protruding top, and the third engaging portion of the ear piece is engaged with the circumferential wall portion of the filter holder.

* * * * *